United States Patent [19]

Yu et al.

[11] 4,339,782

[45] Jul. 13, 1982

[54] SUPERSONIC JET IONIZER

[75] Inventors: Henry H. S. Yu; Richard K. Teague, both of Winston-Salem, N.C.

[73] Assignee: The Bahnson Company, Winston-Salem, N.C.

[21] Appl. No.: 134,361

[22] Filed: Mar. 27, 1980

[51] Int. Cl.[3] ..... H01H 143/32; B03C 3/00

[52] U.S. Cl. ..... 361/229; 55/131; 55/138; 55/152

[58] Field of Search ..... 361/226, 227, 228, 229, 361/230, 231; 55/131.6, 138, 150–153; 239/3, 690

[56] References Cited

U.S. PATENT DOCUMENTS

| | | | |
|---|---|---|---|
| 1,442,052 | 1/1923 | Dane | 55/151 |
| 2,822,058 | 2/1958 | Roos | 55/131 |
| 3,317,790 | 5/1967 | Whitby | 361/230 |
| 3,400,513 | 9/1968 | Boll | 55/152 |
| 3,757,491 | 9/1973 | Gourdine | 361/230 X |
| 4,039,145 | 8/1977 | Felici et al. | 361/227 X |

FOREIGN PATENT DOCUMENTS

| | | | |
|---|---|---|---|
| 842689 | 6/1939 | France | 361/227 |
| 457192 | 6/1973 | U.S.S.R. | 361/231 |

*Primary Examiner*—Bernard Nozick

*Attorney, Agent, or Firm*—Dann, Dorfman, Herrell & Skillman

[57] ABSTRACT

A supersonic jet ionizer (10) comprises dielectric structure defining a chamber (30) for receiving pressurized gas and a convergent-divergent nozzle (31) for causing the gas to issue from the chamber (30) in a jet at supersonic velocity. A high-voltage electrode tip (51) and a grounded metallic ring (60) are mounted in a diverging region (41) of the nozzle (31) so that a corona can be maintained in the diverging region (41). Ions formed in the corona are swept out of the nozzle (31) by the supersonic gas jet. The supersonic jet ionizer (10) can be utilized as a particulate charging means in a system (75) for filtering charged particulates from a particulate-laden gas stream.

9 Claims, 2 Drawing Figures

SUPERSONIC JET IONIZER

BACKGROUND OF THE INVENTION

1. Field of the Invention

This invention pertains to apparatus for generating a supersonic jet of gaseous ions.

This invention also pertains to a filtration system comprising a supersonic jet ionizer for imparting electric charge to particulates in a gas stream, and a filter medium disposed downstream of the ionizer for electrostatically removing charged particulates from the gas stream.

2. State of the Prior Art

An apparatus for generating a sonic jet of gaseous ions was described in U.S. Pat. No. 3,317,790. Use of a sonic jet ionizer for imparting electric charge to particulates in a gas stream in order to enhance the filtration efficiency of a downstream filter medium was described in co-pending U.S. patent application Ser. No. 061,978 filed on July 30, 1979 now abandoned.

In a typical jet ionizer, an electric field is established between an elongate high-voltage electrode and a grounded metallic plate, with the high-voltage electrode being mounted in a gas-receiving chamber and the grounded plate serving as a wall of the chamber. This geometric configuration produces an electric field of sufficient strength to establish a corona in the region adjacent the high-voltage electrode. The gas-receiving chamber is provided with an inlet to admit pressurized gas; and the grounded plate is provided with an aperture to enable the gas to flow as a jet from the chamber. The high-voltage electrode is positioned with respect to the aperture in the grounded plate so that the gas passes through the corona in exiting from the chamber. The corona generates ions in the gas passing therethrough; and the gaseous ions so formed are attracted, depending upon their polarities, toward either the high-voltage electrode or the edge of the exit aperture in the electrically grounded plate. The velocity of gas flow through the corona in a typical jet ionizer is sufficient to cause a significant number of the ions formed in the corona to be swept out of the chamber through the exit aperture before they can reach the high-voltage electrode or the grounded plate.

A jet of gas can be produced by allowing the gas to expand through an aperture from a region of higher pressure into a region of lower pressure. If the gas is allowed to pass from the high-pressure region into the low-pressure region through a nozzle having a flow channel that is much longer than the flow path would be through a simple orifice, a well-formed jet of very high-velocity gas can be obtained. Definitions of the terms "nozzle" and "orifice" as used in the art, and a theoretical discussion of gas flows through nozzles and orifices, are provided in the text entitled *Thermodynamics* by George Hawkins, Wiley Publishing Co., New York, 1951, (Second Edition), pages 313 et seq.

Jet ionizers have been used in basic research for size distribution studies of charged particulates. Practical applications of jet ionizers in industry have generally involved neutralizing electrically charged particles. However, the advantage of a supersonic gas flow from a jet ionizer have not heretofore been recognized in industrial applications; and a practical device for generating a supersonic jet of gaseous ions has not heretofore been available.

OBJECTS AND FEATURES OF THE INVENTION

It is an object of the present invention to provide an apparatus for generating a supersonic jet of gaseous ions.

It is likewise an object of the present invention to provide an ionizer for imparting electric charge to particulates in a gas stream, where the ionizer introduces a supersonic jet of gaseous ions into the particulate-laden gas stream.

It is a further object of the present invention to provide a filtration system comprising a supersonic jet ionizer for imparting electric charge to particulates in a gas stream, and a filter medium positioned downstream of the ionizer for electrostatically removing charged particulates from the gas stream.

A feature of a supersonic jet ionizer according to the present invention is that gaseous ions are formed in a corona maintained in a nozzle through which a jet of gas issues at supersonic velocity. More particularly, in a supersonic jet ionizer according to the present invention, gaseous ions are formed in the divergent portion of a convergent-divergent nozzle through which a jet of gas issues at supersonic velocity.

The ionization efficiency of a jet ionizer is indicated by the ratio of the number of ions in the gas jet issuing from the ionizer to the number of ions formed in the ionizer. An advantage of a supersonic jet ionizer according to the present invention lies in the fact that, for a given ionization efficiency, a much lower mass flow rate of pressurized gas can be used than would be required for a sonic or subsonic jet ionizer. Thus, a supersonic jet ionizer according to the present invention is significantly more economical in terms of pressurized gas consumption than jet ionizers known to the prior art.

It is an advantage of a filtration system according to the present invention that the rate of consumption of pressurized gas using a supersonic jet ionizer is significantly lower than for filtration systems using sonic or subsonic jet ionizers.

DESCRIPTION OF PREFERRED EMBODIMENT

Figure 1:
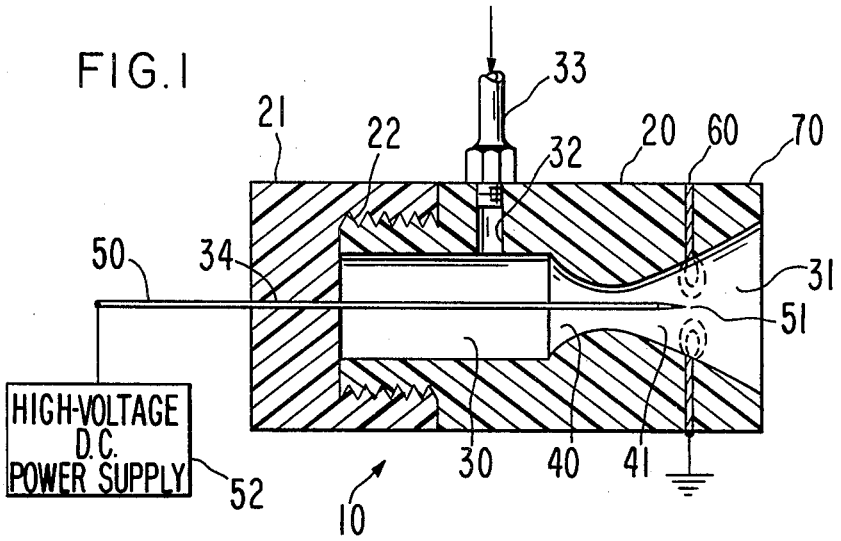
FIG. 1 is a cross-sectional view of a supersonic jet ionizer according to the present invention.

As shown in FIG. 1, a preferred embodiment of a supersonic jet ionizer 10 according to this invention comprises a dielectric gas-receiving and nozzle structure formed from two open-ended dielectric members 20 and 21. The dielectric members 20 and 21 are of generally cylindrical configuration and are coaxially coupled together as by a screw-threaded connection 22. Coupling of the dielectric members 20 and 21 could alternatively be accomplished by glueing, pinning or sealing with a gasket. The dielectric member 20 is internally configured to define a gas-receiving chamber 30 and an adjacent gas-flow exit channel 31 shaped as a convergent-divergent nozzle.

It is convenient to provide a right-circular cylindrical configuration for the gas-receiving chamber 30, with the axis of the chamber 30 coinciding with the cylindrical axis of the dielectric member 20. The convergent-divergent nozzle 31 is conveniently configured to be symmetric about the same axis.

The convergent-divergent nozzle 31 has a converging region 40 located immediately downstream of the chamber 30, and a diverging region 41 located immediately downstream of the converging region 40. The converging region 40 of the nozzle 31 is characterized by a narrowing cross-sectional area in the direction of gas flow, and the diverging region 41 is characterized by a widening cross-sectional area in the direction of gas flow.

The dielectric member 21 is internally configured to define an axial channel 34 through which an elongate high-voltage electrode 50 can be inserted. The channel 34 is coaxial with the gas-receiving chamber 30, and is dimensioned to provide a substantially gas-tight fit between the electrode 50 and the dielectric member 21 so that gas cannot leak to any substantial extent from the chamber 30 through the channel 34. The high-voltage electrode 50 extends axially through the chamber 30 and through the converging region 40 of the nozzle 31 into the diverging region 41.

A channel 32 is provided generally radially through the cylindrical wall of the dielectric member 20 to enable a gas to be introduced under pressure into the chamber 30. A conventional fitting 33 is indicated in FIG. 1 for coupling the channel 32 to a source of pressurized gas such as compressed air.

A thin metallic ring 60 is disposed adjacent the open downstream end of the dielectric member 20; and the interior rim of the ring 60 is configured to form an aerodynamically continuous extension of the diverging region 41. The ring 60 is electrically grounded, and a corona-initiating tip 51 at the end of the high-voltage electrode 50 is positioned generally at the geometric center of the ring 60. In the preferred embodiment illustrated in FIG. 1, the distance from the tip 51 of the electrode 50 to the interior rim of the ring 60 is many times greater than the thickness of the ring 60 in the direction of gas flow through the nozzle 31.

In the preferred embodiment of the invention as illustrated in FIG. 1, the metallic ring 60 is sandwiched between the downstream end of the dielectric member 20 and the upstream end of a dielectric annular member 70. The dielectric annular member 70, like the ring 60, is internally configured to provide a smooth-walled aerodynamically continuous extension of the diverging region 41 of the nozzle 31. Bonding of the ring 60 to the dielectric members 20 and 70 can be accomplished conventionally by, e.g., an epoxy bonding agent.

In an alternative embodiment of the invention, the separate dielectric members 20 and 70 could be replaced by a single dielectric member having a gas-flow exit channel configured as a convergent-divergent nozzle, with a groove being provided transversely on the surface of the diverging region of the gas-flow exit channel to accommodate an electrically grounded metallic ring fitted therein. The interior rim of the metallic ring would be flush with the surface of the exit channel to provide an aerodynamically smooth wall throughout the diverging region of the exit channel.

In operation, a high-pressure gas such as compressed air preferably at a pressure of 30 psig or greater is introduced via the channel 32 into the chamber 30. The gas then passes from the chamber 30 into the converging region 40 of the nozzle 31, and then through a corona maintained in the diverging region 41. As explained in greater detail hereinafter, the convergent-divergent configuration of the nozzle 31 causes the gas to issue from the nozzle 31 in a supersonic jet.

When a d.c. voltage (e.g., 3.5 kilovolts with a 5 microampere direct current) is applied to the high-voltage electrode 50 from a power supply 52, the resulting electric field established between the electrode 50 and the interior rim of the grounded ring 60 is sufficiently strong adjacent the tip 51 of the electrode 50 to initiate a corona. The gas exiting from the chamber 30 passes through the corona in issuing from the nozzle 31, and gaseous ions formed in the corona are accelerated by the electric field toward the interior rim of the ring 60. Some of these ions reach the ring 60, and are thereupon electrically neutralized. The remaining ions, however, are swept out of the nozzle 31 by the supersonic gas flow before they can reach the ring 60.

In accordance with this invention, either a negative or positive voltage could be applied to the high-voltage electrode 50. In operation, whether a negative or a positive voltage is selected would depend upon factors such as the type of gas, the type of particulates in the gas, or other considerations pertinent to the particular application.

The ratio of the number of ions present in the gas jet issuing from the nozzle of a jet ionizer to the number of ions formed in the ionizer is a measure of the ionization efficiency of the ionizer. The probability that any individual ion formed in the corona maintained in the diverging region 41 will reach the grounded ring 60 decreases as the time spent by the ion in the electric field between the high-voltage electrode 50 and the grounded ring 60 decreases. Thus, ionization efficiency increases as the average time spent by the ions in the electric field decreases. The average time spent by the ions in the electric field is a function of the velocity of the gas passing through the electric field. Therefore, a supersonic gas-flow velocity through the electric field in the diverging region 41 of the nozzle 31 is more efficient than a merely sonic or subsonic gas-flow velocity in sweeping ions out of the ionizer 10.

With a jet ionizer having simply an orifice or a convergent nozzle as the gas-flow exit, it is possible to maintain sonic exit velocity for the gas issuing from the ionizer. As discussed in *Thermodynamics* by George Hawkins, op. cit., and in other standard references, sonic exit velocity from such an ionizer can be maintained as long as the ratio of the inlet pressure of the gas introduced into the ionizer to the outlet pressure of the gas at the exit is at least equal to a certain critical value. For air, the critical pressure ratio is 0.53. With such a jet ionizer having simply an orifice or a convergent nozzle as the gas-flow exit, however, the gas exit velocity cannot exceed sonic velocity. With a properly designed convergent-divergent nozzle as the gas-flow exit, on the other hand, it is possible to maintain a supersonic exit velocity for the gas issuing from the ionizer as long as the ratio of the inlet pressure of the gas introduced into the ionizer to the outlet pressure of the gas at the exit is greater than the critical pressure ratio for the particular gas.

The usefulness of a jet ionizer in industrial applications is generally dependent upon the rate at which ions can be emitted from the ionizer. The rate at which ions are emitted from an ionizer depends upon the rate at which ions are formed, as well as upon the efficiency with which the ions so formed are swept out of the ionizer to escape capture by the grounded electrode. With subsonic and sonic jet ionizers of the prior art, the rate of ion formation was increased either by increasing the voltage applied to the high-voltage electrode or by increasing the area of the high-voltage electrode. Increasing the voltage applied to the high-voltage electrode of a subsonic or sonic jet ionizer, however, required increasing the separation between the high-voltage electrode and the grounded electrode in order to prevent arcing. Thus, either increasing the voltage applied to the high-voltage electrode or increasing the area of the high-voltage electrode required increasing the internal dimensions, including the size of the exit orifice, of a subsonic or sonic jet ionizer. Increasing the size of the exit orifice, however, required a corresponding increase in the rate of consumption of high-pressure gas introduced into the ionizer.

With a supersonic jet ionizer in which the grounded electrode and the tip of the high-voltage electrode are located in the diverging region of a convergent-divergent nozzle, the separation between the high-voltage electrode and the grounded electrodes is greater than for a subsonic or sonic jet ionizer having the same minimum cross-sectional exit area. Thus, for a given rate of consumption of high-pressure gas, a higher voltage can be applied to the high-voltage electrode of a supersonic jet ionizer than to the high-voltage electrode of a subsonic or sonic jet ionizer. Thus, for a given rate of consumption of high-pressure gas, the rate of ion formation is greater for a supersonic jet ionizer than for a subsonic or sonic jet ionizer. As discussed above, the efficiency of a supersonic jet ionizer in sweeping ions out through the gas-flow exit so as to avoid capture by the grounded electrodes is higher for a supersonic jet ionizer than for a subsonic or sonic jet ionizer. Thus, a supersonic jet ionizer can be expected to be more useful than a subsonic or sonic jet ionizer in industrial applications.

Figure 2:
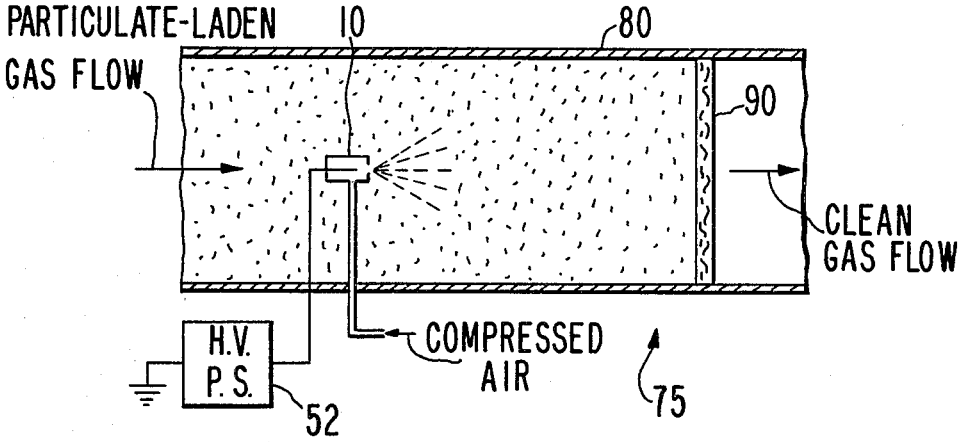
FIG. 2 is a cross-sectional view of an electrostatic filtration system according to the present invention.

In a particular application of the present invention, as illustrated in FIG. 2, ions generated by the supersonic jet ionizer 10 are utilized in a filtration system 75 for imparting electric charge to particulates in a gas stream. The supersonic jet ionizer 10 is shown mounted in the interior of a duct 80 through which the particulate-laden gas stream is directed. As illustrated, the supersonic jet ionizer 10 is mounted centrally within the duct 80 co-current with the gas stream. In particular applications, however, the ionizer 10 could be mounted other than centrally within the duct 80, and could be disposed counter-current or at some other angle with respect to the gas stream. The ionizer 10 could also be mounted externally of the duct 80, with an aperture being provided in the wall of the duct 80 to permit entry of ions generated by the ionizer 10 into the interior of the duct 80. A plurality of supersonic jet ionizers 10 could be mounted for simultaneous use in any of the arrangements described above for the present invention.

A filter medium 90 is disposed downstream of the supersonic jet ionizer 10 to remove charged particulates electrostatically from the gas stream. The filter medium 90 could be, for example, a fabric of electrically resistive fibers, a bed of randomly oriented electrically resistive fibers, or a mat of electrically resistive fibrous material that is collected from the gas stream and agglomerated on a foraminous support structure (e.g., a metallic screen) disposed in the duct 80 transversely to the gas stream.

Particulates in the gas stream passing through the duct 80 are charged by random collisions with the ions issuing from the supersonic jet ionizer 10. Unlike field charging techniques, there is no externally applied electric field to direct the motion of the ions introduced into the particulate-laden gas stream. Thus, ions that escape collision with particulates in the gas stream migrate toward the walls of the duct 80 and are carried downstream toward the filter medium 90 by the gas stream. The distance of the filter medium 90 from the ionizer 10 can be selected, depending upon the velocity of the gas stream and the dimensions of the duct 80, to minimize dissipation of ions to the walls of the duct 80. Ions impinging on the filter medium 90 serve to impart electric charge thereto, thereby enhancing the filtration efficiency of the filter medium 90.

In a particular embodiment of an electrostatic filtration system according to the present invention, the supersonic jet ionizer 10 is located a sufficient distance upstream of the filter medium 90 so that particulates in the gas stream are exposed to an ion concentration of about $10^6$ ions per cubic centimeter for several 10ths of a second. This arrangement provides suitable conditions for the particulates to encounter collisions with ions, and thereby to acquire electric charge from the ions. With a typical gas flow velocity of 300 feet per minute through the duct 80, a separation of about four feet between the supersonic jet ionizer 10 and the filter medium 90 would be suitable.

The present invention has been described above in terms of particular structural details. Alternative design details and other applications of the invention could be envisioned, however, by those skilled in the art. The above description is therefore to be construed as illustrative of the invention and not as limiting; and the scope of the invention is defined by the following claims and their equivalents.

What is claimed is:

1. A supersonic jet ionizer comprising:

(a) an electrode connectable to a high-voltage power supply;

(b) a dielectric structure defining a chamber and a nozzle, said nozzle being in gas-flow communication with said chamber, said dielectric structure having a first channel for admission of a pressurized gas into said chamber, said nozzle being configured to enable said gas to exit from said chamber by passing initially through a region of narrowing cross-sectional area and thereafter through a region of widening cross-sectional area, said dielectric structure having a second channel for insertion of a tip of said high-voltage electrode into said region of widening cross-sectional area; and (c) an electrically conductive member mounted in said region of widening cross-sectional area of said nozzle, said electrically conductive member being connectable to ground potential so that an electric field can be maintained between said high-voltage electrode and said electrically conductive member.

2. The supersonic jet ionizer of claim 1 wherein said chamber defined by said dielectric structure is of substantially cylindrical configuration, said nozzle communicating with a first end of said chamber.

3. The supersonic jet ionizer of claim 2 wherein said grounded electrically conductive member is of annular configuration, and is positioned circumjacent said region of widening cross-sectional area of said nozzle.

4. The supersonic jet ionizer of claim 3 wherein said grounded electrically conductive member is sandwiched between and bonded to said dielectric structure and an annular dielectric member, said grounded electrically conductive member and said annular dielectric member being configured to provide a smooth-walled continuation of said region of widening cross-sectional area of said nozzle.

5. The supersonic jet ionizer of claim 2 wherein said chamber is of generally circular cylindrical configuration, said nozzle being substantially symmetric about an axis that is coincident with the cylindrical axis of said chamber.

6. The supersonic jet ionizer of claim 5 wherein said dielectric structure comprises first and second open-ended cylindrical members, said first member being configured to define said chamber and said nozzle, said second member being configured to define said second channel, said first and second members being coupled so that said second channel is coaxial with said chamber and said nozzle.

7. The supersonic jet ionizer of claim 6 wherein said first and second members of said dielectric structure are coupled by a screw thread connection.

8. The supersonic jet ionizer of claim 5 wherein said high-voltage electrode is elongate, and wherein said second channel extends into said dielectric structure along the cylindrical axis of said chamber so that said high-voltage electrode can be inserted through said second channel to a position at which said tip of said high-voltage electrode lies on said axis in said region of widening cross-sectional area of said nozzle.

9. The supersonic jet ionizer of claim 8 wherein said first channel extends into said dielectric structure radially with respect to the cylindrical axis of said chamber.

* * * * *